US008274025B2

(12) United States Patent
Geswender et al.

(10) Patent No.: US 8,274,025 B2
(45) Date of Patent: Sep. 25, 2012

(54) AIRCRAFT WITH SEGMENTED DEPLOYABLE CONTROL SURFACES

(75) Inventors: Chris E. Geswender, Green Valley, AZ (US); Craig O. Shott, Benson, AZ (US)

(73) Assignee: Raytheon Company, Waltham, MA (US)

( * ) Notice: Subject to any disclaimer, the term of this patent is extended or adjusted under 35 U.S.C. 154(b) by 293 days.

(21) Appl. No.: 12/843,921

(22) Filed: Jul. 27, 2010

(65) Prior Publication Data

US 2012/0025009 A1 Feb. 2, 2012

(51) Int. Cl.
*F42B 15/01* (2006.01)

(52) U.S. Cl. ..... 244/3.27; 244/3.24

(58) Field of Classification Search ..... 244/3.1, 244/3.21, 3.23, 3.24, 3.27, 3.28, 3.29; 102/473, 102/501

See application file for complete search history.

(56) References Cited

U.S. PATENT DOCUMENTS 4,745,861 A * 5/1988 Fenton et al. ..... 102/377
4,778,127 A * 10/1988 Duchesneau ..... 244/3.29
6,779,754 B2 * 8/2004 Hellman ..... 244/3.27
2003/0089820 A1 * 5/2003 Martorana et al. ..... 244/3.1
2003/0146342 A1 * 8/2003 Hellman ..... 244/3.27
2010/0102161 A1 * 4/2010 Geswender et al. ..... 244/3.27
2010/0308153 A1 * 12/2010 Cohe et al. ..... 244/3.27
2010/0314488 A1 * 12/2010 Ashkenazi ..... 244/3.27
2010/0326309 A1 * 12/2010 Nurminen et al. ..... 102/473
2011/0024550 A1 * 2/2011 McDermott et al. ..... 244/3.27

* cited by examiner

*Primary Examiner* — Christopher P Ellis
*Assistant Examiner* — Medhat Badawi
(74) *Attorney, Agent, or Firm* — Renner, Otto, Boisselle & Sklar, LLP

(57) ABSTRACT

An aircraft, such as a missile, has control surfaces that have segments that are hinged together. The control surfaces deploy from a closed position, for example with the segments folded against a fuselage, so as to allow for launching from a launch tube. Once the aircraft is launched the control surfaces deploy from the closed position to an open position, with the segments opening up farther from the body or fuselage. In the open position or deployed state the segments may be substantially planar. Locks of the control surfaces may be used to lock the segments in place in the open position. The locks may include hollow sleeves that slide over the control surface segments. The sleeves and the segments may include a protrusions and depressions that engage each other to hold the segments in the open configuration.

19 Claims, 5 Drawing Sheets

AIRCRAFT WITH SEGMENTED DEPLOYABLE CONTROL SURFACES

BACKGROUND OF THE INVENTION

1. Technical Field of the Invention

The invention is in the field of deployable control surfaces for aircraft.

2. Description of the Related Art

Prior deployment systems of control surfaces, such as canards or fins, for projectiles of missiles, have sometimes relied upon centrifugal forces for deployment. There is general room for improvement in the field of deployment of control surfaces for projectiles and missiles.

SUMMARY OF THE INVENTION

According to an aspect of the invention, an aircraft has deployable segmented control surfaces. The segments are hingedly coupled to each other, allowing one segment to pivot relative to an adjacent segment, with the control surfaces also hingedly coupled to the aircraft's fuselage to pivot relative to the fuselage. The locks such as sleeves may be mounted on the control surfaces, to lock the control surface segments into position (preventing pivoting) when the control surfaces reach a deployed state.

According to another aspect of the invention, an aircraft includes: a fuselage; and a control surface that deploys from a stowed state in which the control surface is wrapped around the fuselage. The control surface includes: control surface segments that are hingedly coupled together; and locks to hold the control surface segments in a deployed state of the control surface.

According to yet another aspect of the invention, a method of aircraft flight includes the steps of: launching an aircraft from a launcher, with control surfaces of the aircraft in a stowed state, along a fuselage of the aircraft; spinning the aircraft during and/or after the launching; and after the launching, deploying the control surfaces. The deploying includes control surface segments of each of the control surfaces opening up to deployed state by pivoting on hinged connections between the segments of each control surface, and/or by pivoting on hinged connections between the control surfaces and the fuselage; and sliding locks of the control surfaces in place over the hinged connections between the segments, to maintain the control surfaces in the deployed state.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various features of the invention.

DETAILED DESCRIPTION

An aircraft, such as a missile, has control surfaces that have segments that are hinged together. The control surfaces deploy from a closed position, for example with the segments folded against a fuselage, so as to allow for launching from a launch tube. Once the aircraft is launched the control surfaces deploy from the closed position to an open position, with the segments opening up farther from the body or fuselage. In the open position or deployed state the segments may be substantially planar. Locks of the control surfaces may be used to lock the segments in place in the open position. The locks may include hollow sleeves that slide over the control surface segments. The sleeves and the segments may include a protrusions and depressions that engage each other to hold the segments in the open configuration.

Figure 1:
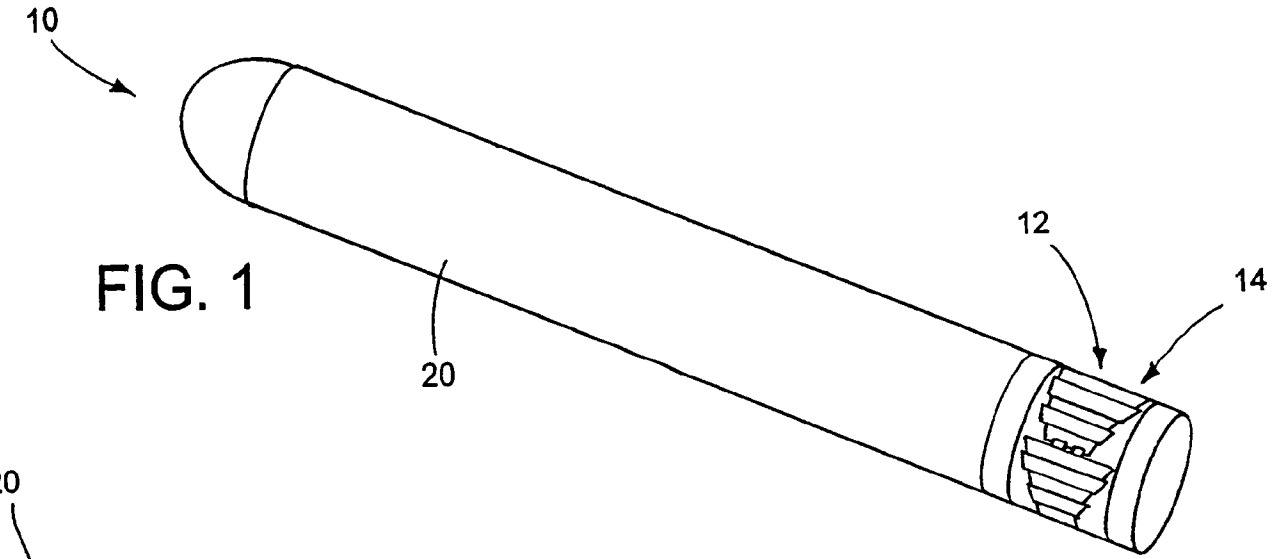
FIG. 1 is an oblique view of an aircraft in accordance with an embodiment of the present invention, with control surfaces in a stowed or closed configuration or state.
Figure 2:
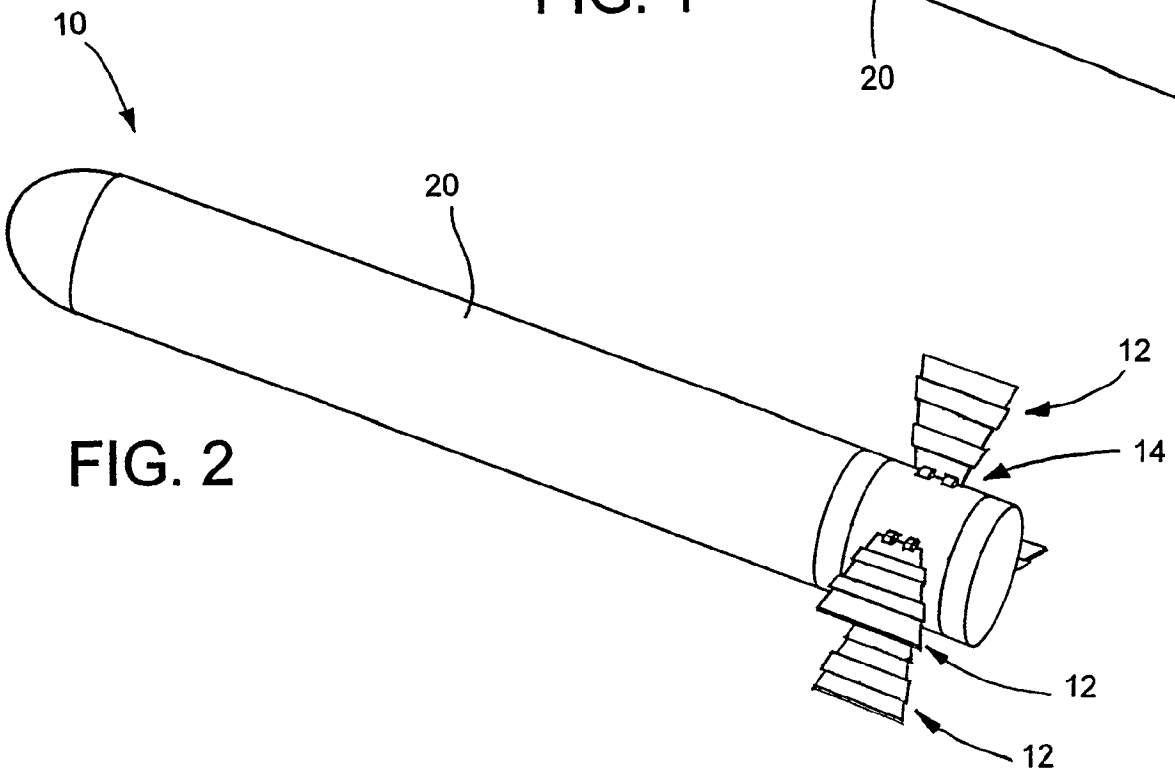
FIG. 2 is an oblique view of the aircraft of FIG. 1, with the control surfaces in a deployed configuration or state.
Figure 4:
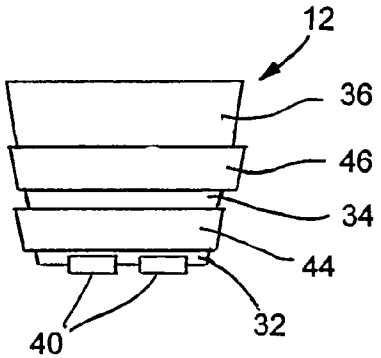
FIG. 4 is top view of the control surface of FIG. 3.

FIGS. 1 and 2 show an aircraft 10, such as a missile, that includes control surfaces 12 that deploy from a recess 14 in a fuselage 20. In the illustrated embodiment the control surfaces 12 are fins, but it will be appreciated that the control surfaces 12 may be any of a variety of appendages that provide lift, stabilize, and/or steer the aircraft 10. For example the controls surfaces 12 may be fins, canards, wings, or tails, to give a few examples. FIG. 1 shows the control surfaces 12 in a stowed or closed configuration, while FIG. 2 shows the control surfaces 12 in a deployed or open configuration.

Figure 6:
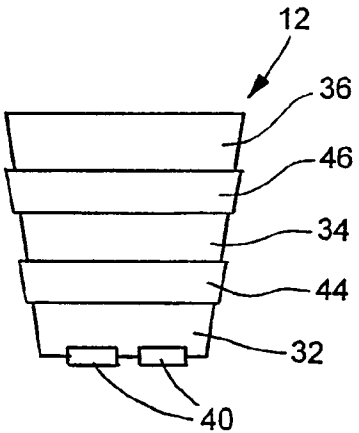
FIG. 6 is top view of the control surface of FIG. 5.
Figure 3:
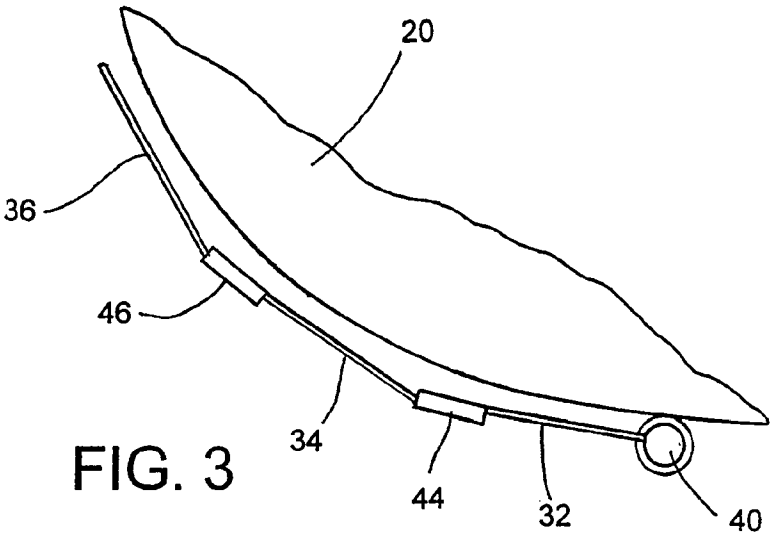
FIG. 3 is an end view of part of the aircraft of FIG. 1, showing one of the control surfaces in a stowed or closed state.
Figure 5:
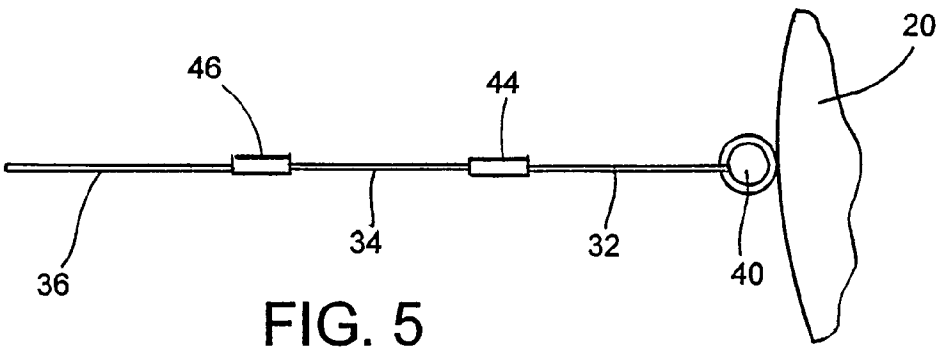
FIG. 5 is an end view of part of the aircraft of FIG. 1, showing one of the control surfaces in a deployed state.

With reference now in addition to FIGS. 3-6, each of the control surfaces 12 includes multiple control surface segments, hingedly coupled to one another and to the fuselage 20. In the illustrated embodiment each of the control surfaces 12 includes three control surface segments 32, 34, and 36, although it will be appreciated that a greater or lesser number of control surface segments can be employed, for example four or more segments. In the stowed configuration (FIGS. 1 3, and 4) the segments 32-36 are angled more at their hinged couplings than they are in the deployed configuration (FIGS. 2, 5, and 6). In the deployed configuration the segments 32-36 pivot along the hinged connections to open, and may be substantially coplanar, with a substantially zero angle at the hinged couplings between them.

The control surface segments 32-36 include a root section or segment 32, which is hingedly coupled to the fuselage 20, a center section or segment 34, which is hingedly coupled to the root section 32, and a tip section or segment 36, which is hingedly coupled to the center section 34. An attachment hinge 40 is used to hingedly couple the root section 32 to the fuselage 20. The attachment hinge 40 may be any of a variety of suitable hinges. Similar hinges may be used to hingedly couple together the various segments or sections 32-36.

The control surface segments 32-36 may be made of any of a variety of suitable materials. Examples of such materials include metals such as steel, aluminum, and titanium, as well as composite materials.

The control surface segments 32-36 may have a negative taper shape, with a chord of the segments 32-36 steadily increasing from a minimum value near the attachment hinge 40 to a maximum value at the distal free end of the control surface 12. In other words, the general shape of some or all of the control surface segments 32-36 may be parallelograms, with the shorter of their parallel sides closer to the fuselage 20. Such a tapered shape may aid in properly positioning a pair of locks 44 and 46, which in the illustrated embodiment are sleeves that slide along the segments 32-36. The locks 44 and 46 are used to lock the control surface segments 32-36 into place in the deployed state. The locks 44 and 46 may slide outward along the control surface segments 32-36 until the lock 44 overlies the hinge between the root section 32 and the center section 34, and the lock 46 overlies the hinge between the center section 34 and the tip section 36.

The locks 44 and 46 may be tapered sleeves that aid in their proper positioning relative to the control surface segments 32-36. To be more specific, the lock 44 may have a size and shape such that it is limited in its ability to slide outward along the control surface 12 by contact with the root section 32 and/or the center section 34. The shape may be such that the lock 44 reaches the outward limit in its travel when the lock 44 overlies the connection between the root section 32 and the center section 34. The lock 44 may have a tapered shape that corresponds in dimensions to a cross-sectional shape of the sections 32 and 34 in the vicinity of the connection between the sections 32 and 34. The movement of the lock 44 outward may cause a pressing of the lock 44 against one or both of the sections 32 and 34 that prevents further outward movement. The stop that the sections 32 and/or 34 provide to the lock 44 may be akin to an interference fit between the parts that holds the lock 44 in place relative to the other parts of the control surface 12.

It will be appreciated that the lock 46 may be similarly limited in its travel by contact with the sections 34 and/or 36. The deployment of the segments 32-36 may be encouraged by rotation or rolling (spinning) of the aircraft 10 about a longitudinal axis 48 of the aircraft, with centrifugal forces tending to push the sections 32-36 outward, pivoting them toward the deployed state. Centrifugal forces from rotation of the aircraft 10 may also encourage the movement of the locks 44 and 46 outward, from their initial respective positions of being over portions of the control surface segments 32 and 34.

It will also be appreciated that the locks 44 and 46 may include some locking mechanism to secure the locks 44 and 46 in place once the locks 44 and 46 have reached desired positions where they prevent relative movement of the segments 32-36. The locking mechanism(s) can take any of a variety of suitable forms, only some of which are described herein. One broad type of locking mechanism is a protrusion or recess on the locks 44 and 46 that engages a recess or protrusion on the segments 32-36. It will be appreciated that this sort of locking mechanism may take any of a wide variety of forms. The forms may include parts that utilize resiliently deformable parts, and/or springs. One example of use of a spring would be use of a spring pin in one part that would engage a recess or depression in another part. Each of the locks 44 and 46 may have a lock mechanism to hold it in place relative to the segments 32-36.

Figure 7:
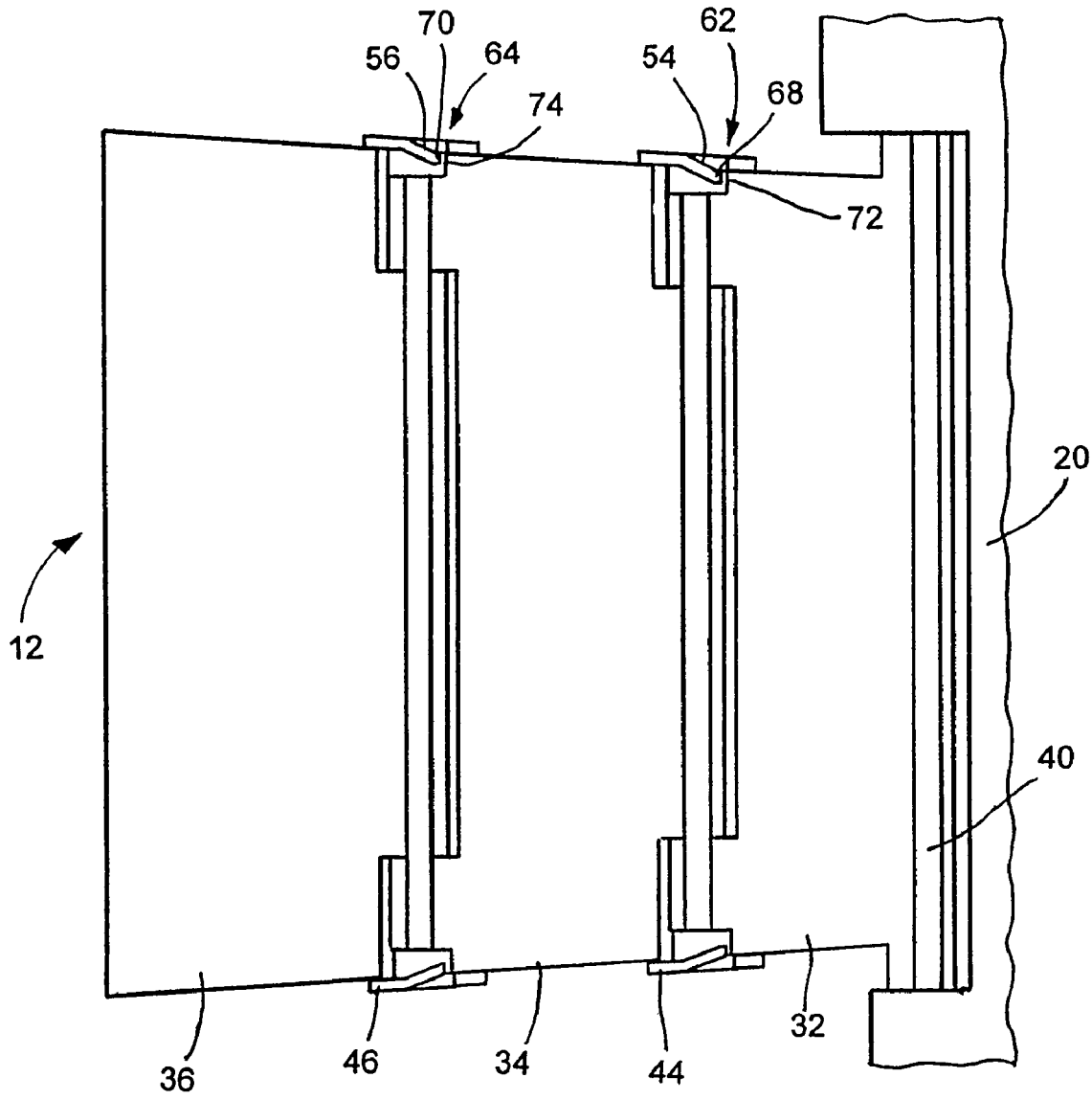
FIG. 7 is a view showing one embodiment of a locking mechanism for the control surface of FIG. 1.

FIG. 7 illustrates one possible lock mechanism, a negative lock mechanism for holding the locks 44 and 46 in place with the control surface 12 in a deployed (open) state. The locks 44 and 46 have respective spring fingers 54 and 56 on them that are configured to engage depressions 62 and 64 in the control surface segments 32 and 34. The spring fingers 54 and 56 protrude inward from the distal ends of the locks 44 and 46 that are farthest from the fuselage 20.

Initially, when the control surface 12 is in the closed position or state, the spring fingers 54 and 56 are in contact with the outer surfaces of the control surface segments 32 and 34. As the locks 44 and 46 slide outward the spring fingers 54 and 56 move toward the depressions 62 and 64. When the locks 44 and 46 slide outward far enough to reach the deployed or open position or state, the spring fingers 54 and 56 reach the depressions 62 and 64. The spring fingers 54 and 56 then snap inward into the depressions 62 and 64. The inward movement of the spring fingers 54 and 56 prevents the locks 44 and 46 from sliding back to their previous positions. Sliding of the locks 44 and 46 back toward the body 20 would cause ends 68 and 70 of the spring fingers 54 and 56 to bump up against proximal side walls 72 and 74 of the depressions 62 and 64, preventing further inward movement of the locks 44 and 46. The lock mechanism shown in FIG. 7 is a negative lock mechanism in that the spring fingers 54 and 56 prevent the lock mechanism from sliding back toward the body 20, rather than acting as a positive stop to outward motion of the locks 44 and 46. In this configuration the ends 68 and 70 of the spring fingers 54 and 56 point toward the body 20.

Figure 8:
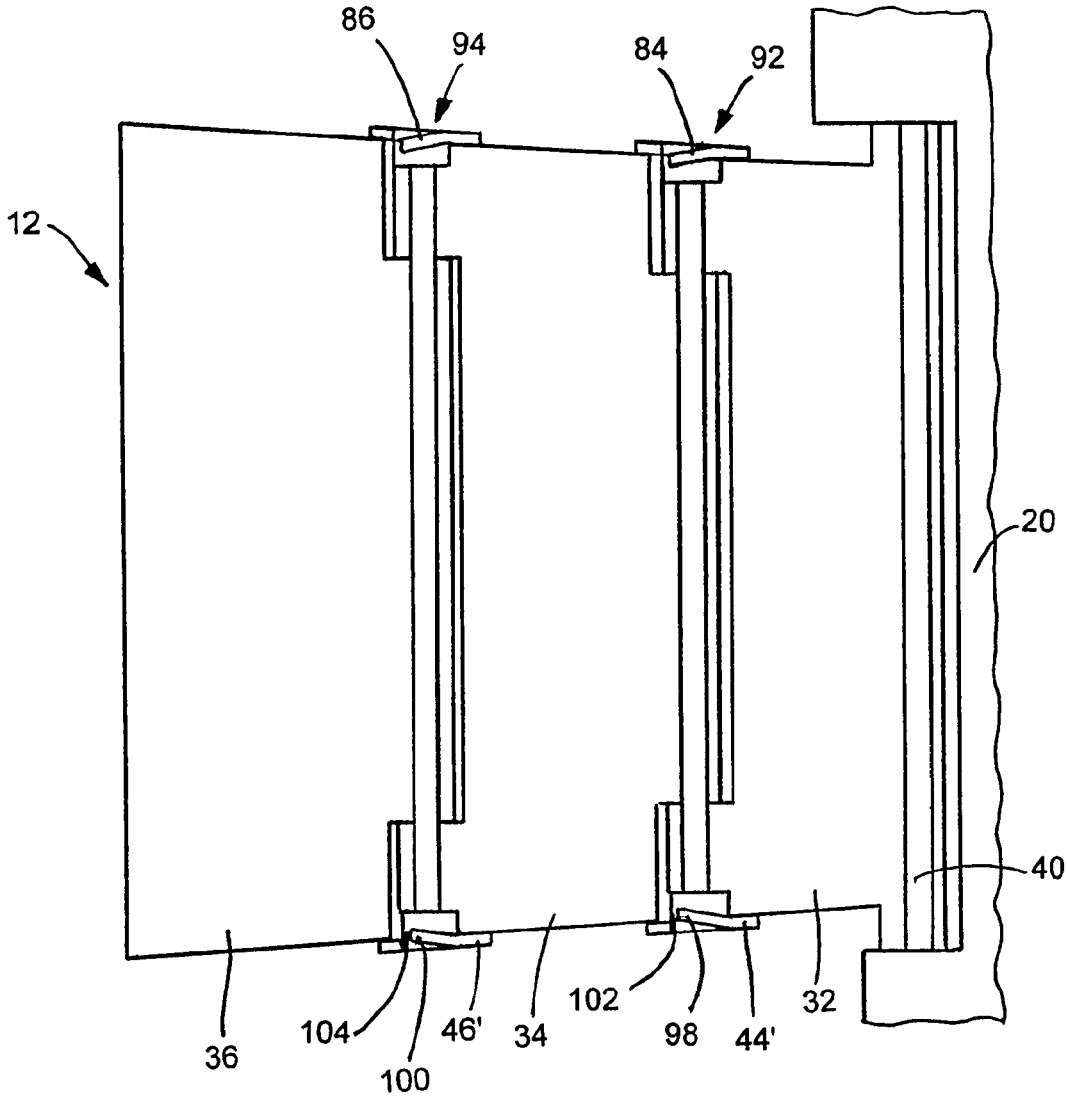
FIG. 8 is a view showing another embodiment locking mechanism for the control surface of FIG. 1.

FIG. 8 illustrates a positive locking mechanism for securing locks 44' and 46' (variant embodiments of the locks 44 and 46) in place. The mechanism shown in FIG. 8 involves inward-protruding spring fingers 84 and 86 that spring inward into depressions 92 and 94 as the locks 44' and 46' the move into place over the hinged connections between the control surface segments 32-36. The spring fingers 84 and 86 are positive locking devices in that outward motion of the locks 44' and 46' along the control surface 12 is positively constrained by contact of ends 98 and 100 of the spring fingers 84 and 86 with distal side walls 102 and 104 of the depressions 92 and 94. In this configuration the ends 98 and 100 point away from the body 20.

Figure 9:
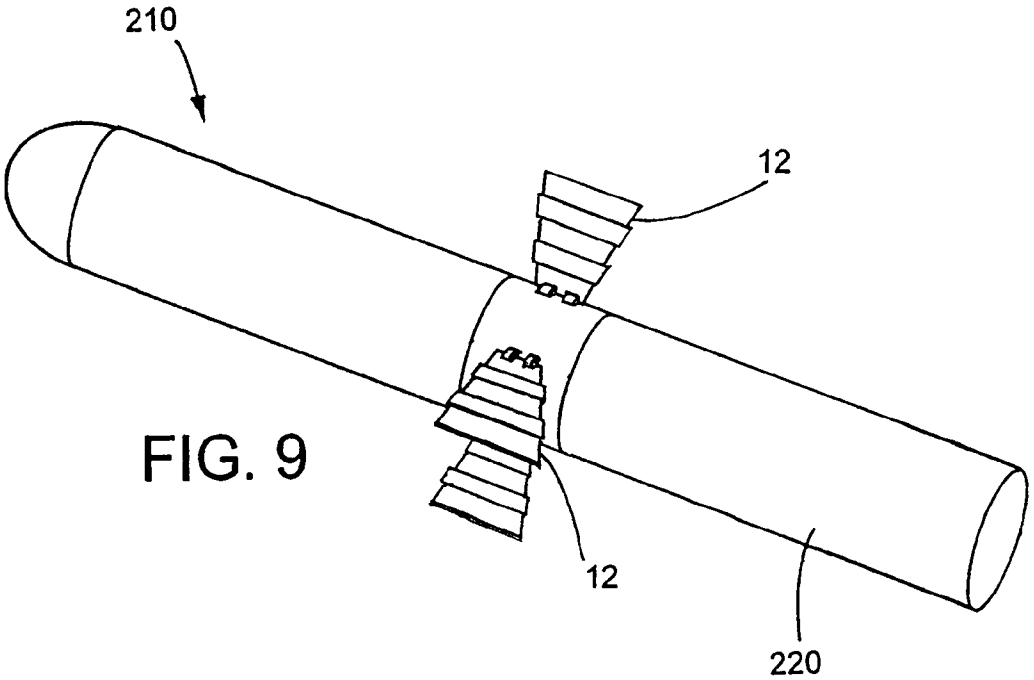
FIG. 9 is an oblique of an alternate embodiment aircraft in accordance with the present invention.
Figure 10:
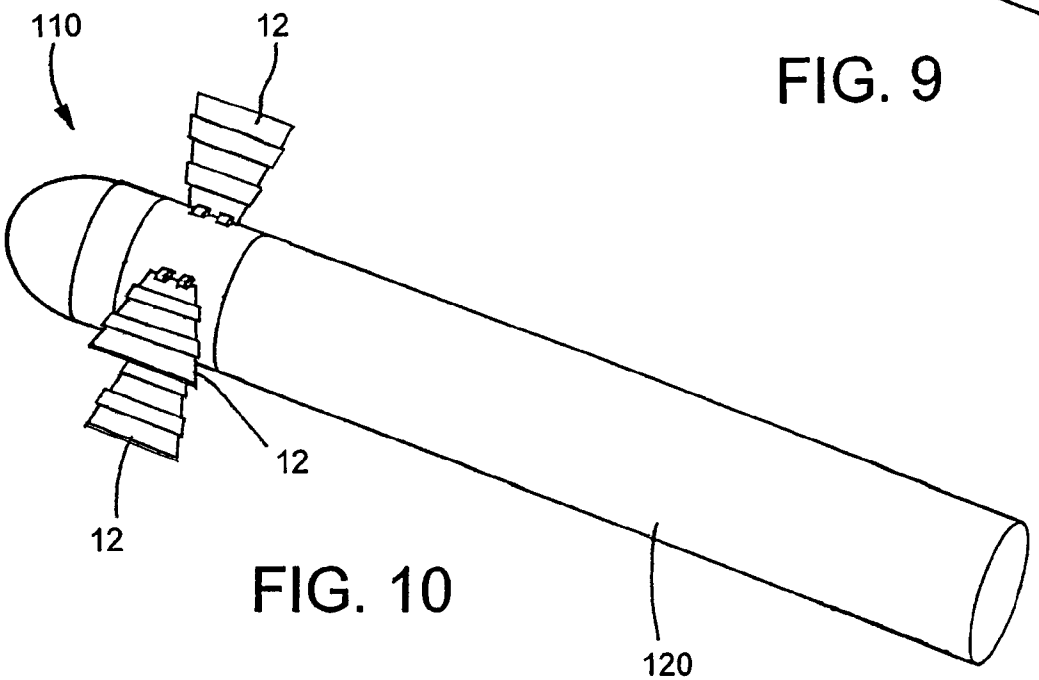
FIG. 10 is an oblique of another alternate embodiment aircraft in accordance with the present invention.

FIG. 9 shows an alternate embodiment, an aircraft 110 in which the control surfaces 12 are wings emerging from a fuselage 120. FIG. 10 shows another alternate embodiment, an aircraft 210 in which the control surfaces 12 are canards emerging from a fuselage 220.

It will be appreciated that the various embodiments discussed above are only examples, and many other embodiments are possible. While it may be advantageous to have the control surface 12 taper outward as shown, it will be appreciated that the control surface 12 may have other shapes, such as a substantially constant chord, or a chord varying in other ways. Different sort of locks and locking mechanisms may be used. The control surface 12 may be substantially straight in its deployed state, or may be curved or have angled sections.

The aircraft 10 may be a missile that is launched from a launch tube or other launcher. The control surfaces 12 may be initially in the undeployed (closed or stowed) state, close in against the fuselage 20, which may facilitate loading of the aircraft 10 into the launcher. The aircraft 10 may be spun about its longitudinal axis as part of the launching process. When the aircraft 10 emerges from the launcher, the spinning may aid in deploying of the control surfaces 12. The spinning provides centrifugal forces that tend to force the control surfaces 12 outward, straightening the control surface segments 32-36 out toward the deployed state of the control surfaces 12. The locks 44 and 46 may also slide outward, locking the control surface segments 32-36 into place in the deployed state.

The control surfaces described herein provide an advantageous way of having control surfaces that are in a stowed or closed (undeployed) compact state prior to and during launch, and deploy to an open state during flight. The control surfaces are made up of rigid segments, which improves effectiveness relative to flexible control surfaces such as flexible wrap-around fins. In addition, there are no expensive or complicated deployment mechanisms used in deploying the control surfaces described herein. Nor is there a need to have slots in the fuselage that control surfaces deploy from. It is also an advantage that the control surfaces 12 deploy on their own, for example making use of centrifugal forces from spinning of the aircraft 10 along its longitudinal axis.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An aircraft comprising:

a fuselage; and a control surface that deploys from a stowed state in which the control surface is wrapped around the fuselage;

wherein the control surface includes:

control surface segments that are hingedly coupled together; and locks to hold the control surface segments in a deployed state of the control surface; and wherein the locks are hollow sleeves that slide along control surface segments, and that cover hinged couplings between the control surface segments, when the control surface is in the deployed state.

2. The aircraft of claim 1, wherein the control surface is a canard or a wing.

3. The aircraft of claim 1, wherein the control surface is a tail fin.

4. The aircraft of claim 1, wherein the aircraft is a missile.

5. The aircraft of claim 1, wherein the control surface segments have depressions therein that receive inward-protruding parts of the locks, to secure the locks from sliding relative to the control surface segments, when the control surface is in the deployed state.

6. The aircraft of claim 5, wherein the inward-protruding parts include spring fingers.

7. The aircraft of claim 6, wherein the spring fingers have free ends that point toward the fuselage.

8. The aircraft of claim 6, wherein the spring fingers have free ends that point away the fuselage.

9. The aircraft of claim 1, wherein the control surface segments consist of three control surface segments.

10. The aircraft of claim 1, wherein the control surface is substantially planar when in the deployed state.

11. An aircraft comprising:

a fuselage; and a control surface that deploys from a stowed state in which the control surface is wrapped around the fuselage;

wherein the control surface includes:

control surface segments that are hingedly coupled together; and locks to hold the control surface segments in a deployed state of the control surface; and wherein the control surface segments each have a smaller chord at a proximal end closest to the fuselage, than at a distal end distal from the fuselage.

12. The aircraft of claim 11, wherein the control surface segments have a substantially parallelogram shape.

13. The aircraft of claim 11, wherein the locks are sleeves have non-uniform width that corresponds to chord variations in the control surface.

14. The aircraft of claim 13, wherein the sleeves make an interference fit with the control surface segments to prevent bending at the hinged couplings between the control surface segments, when the control surface is in the deployed state.

15. The aircraft of claim 1, wherein the locks each include a lock mechanism that secures the locks relative to the control surface segments, to hold the control surface segments in the deployed state.

16. The aircraft of claim 15, wherein the lock mechanism includes protrusion on one of the locks or the control surface segments, that engages a recess on the other of the locks or the control surface segments.

17. The aircraft of claim 1, wherein the control surface is in a recess in the fuselage when in the stowed state.

18. A method of aircraft flight, the method comprising:

launching an aircraft from a launcher, with control surfaces of the aircraft in a stowed state, along a fuselage of the aircraft;

spinning the aircraft during and/or after the launching; and after the launching, deploying the control surfaces, wherein the deploying includes:

control surface segments of each of the control surfaces opening up to deployed state by pivoting on hinged connections between the segments of each control surface, and/or by pivoting on hinged connections between the control surfaces and the fuselage; and sliding locks of the control surfaces in place over the hinged connections between the segments, to maintain the control surfaces in the deployed state.

19. The method of claim 18, wherein the sliding the locks includes sliding sleeves that enclose the control surface segments.

* * * * *